US005236344A

United States Patent [19]

Baron

[11] Patent Number: 5,236,344

[45] Date of Patent: Aug. 17, 1993

[54] PANEL FIXTURE

[75] Inventor: Peter Baron, Waterloo, Australia

[73] Assignee: Australian Slatwall Industries Pty. Limited, Waterloo, Australia

[21] Appl. No.: 717,203

[22] Filed: Jun. 18, 1991

[51] Int. Cl.[5] ..... A47B 96/06

[52] U.S. Cl. ..... 248/222.2; 211/59.1

[58] Field of Search ..... 248/222.2, 220.2, 222.3, 248/223.3, 220.3; 211/57.1, 59.1

[56] References Cited

U.S. PATENT DOCUMENTS

| | | | |
|---|---|---|---|
| 66,341 | 7/1864 | Holden . | |
| 459,844 | 9/1891 | Thomas . | |
| 3,337,172 | 8/1967 | Jackson | 248/222.2 |
| 3,704,675 | 12/1972 | Bellasalma . | |
| 4,211,379 | 7/1980 | Morgan . | |
| 4,502,602 | 3/1985 | Swanson | 211/57.1 X |
| 4,783,033 | 11/1988 | Valiulis | 211/59.1 X |
| 4,809,940 | 3/1989 | Trestyn | 248/222.2 X |
| 4,860,905 | 8/1989 | Schott et al. | 211/59.1 |
| 4,884,702 | 12/1989 | Rekow | 248/222.2 X |
| 4,917,337 | 4/1990 | Gridley | 248/222.2 X |
| 4,944,416 | 7/1990 | Petersen et al. | 248/222.2 X |

FOREIGN PATENT DOCUMENTS 0333519 9/1989 European Pat. Off. .

2119231 11/1989 United Kingdom .

*Primary Examiner*—Ramon O. Ramirez

*Attorney, Agent, or Firm*—Ladas & Parry

[57] ABSTRACT

A panel fixture adapted to be inserted into a cavity formed in a panel, the panel fixture releasably receiving an accessory. The panel fixture can be mounted within a routed cavity in a panel or wall such that its faceplate can be substantially flush with the panel surface or wall surface to provide a convenient, randomly selected location for supporting an accessory such as a hook bracket or a shelf support bracket. The mounting of the panel fixture into the cavity simultaneously holds the panel against a wall structure. The faceplate has a slot located in an upper portion of the fixture. An accessory bracket to be inserted in the fixture may have a stepped upper plate part and a planar lower plate part and is mountable in/on the fixture with the stepped upper plate part of the accessory bracket inserted and confined in the slot of the fixture faceplate, and with the planar plate part of the accessory bracket fitting flat against the recessed planar surface of the body of the fixture.

A separate cover closure plate is provided, whereby when an accessory is not received in the panel fixture, the cover closure plate is fitted into the panel fixture.

19 Claims, 2 Drawing Sheets

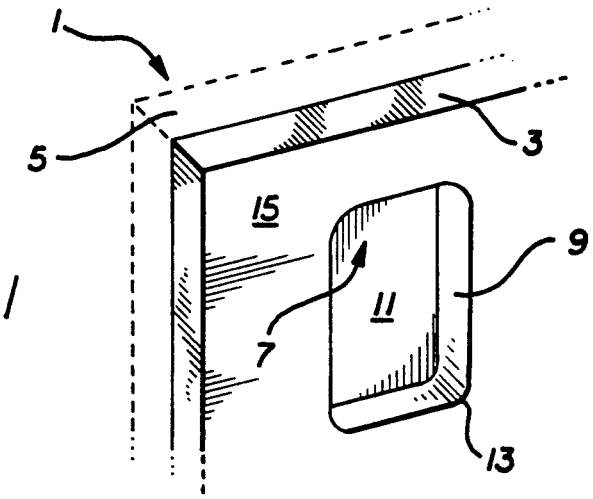
FIG. 1
FIG. 2
FIG. 3
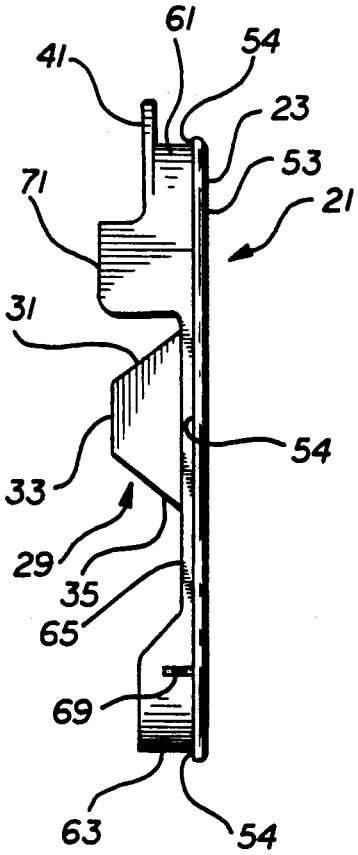
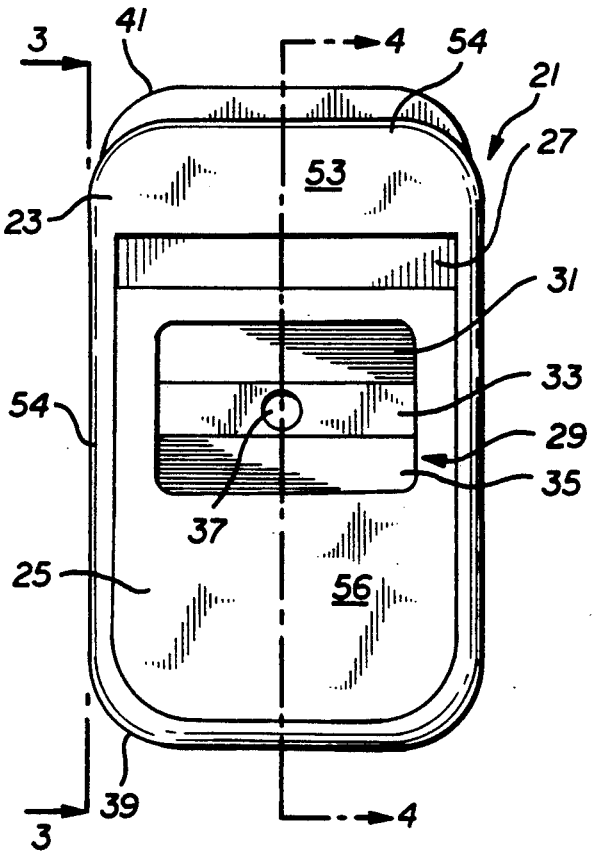

FIG. 4
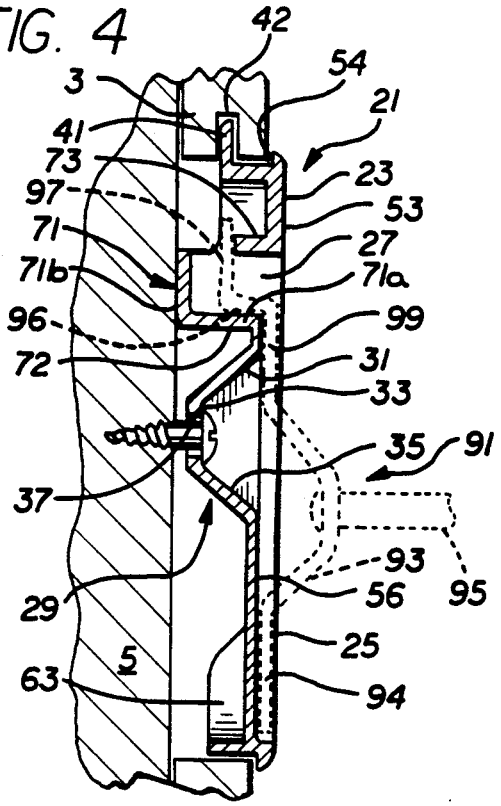
FIG. 4a
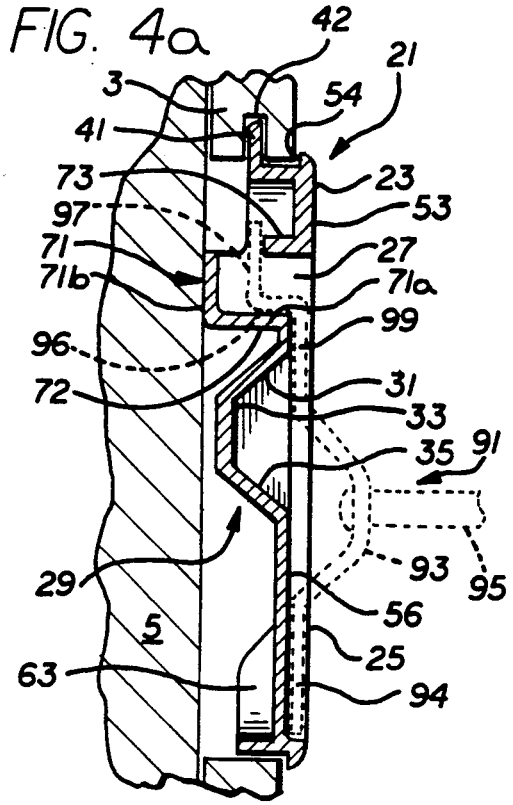
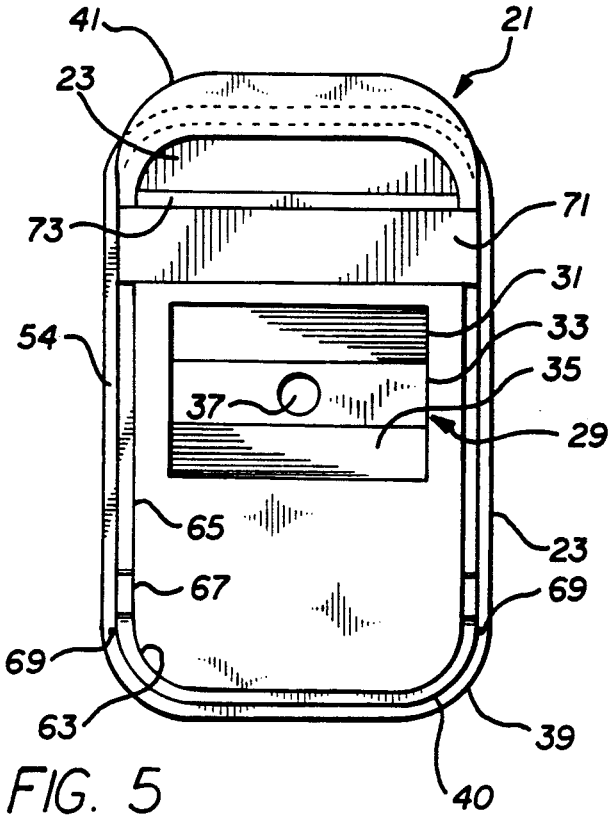
FIG. 5
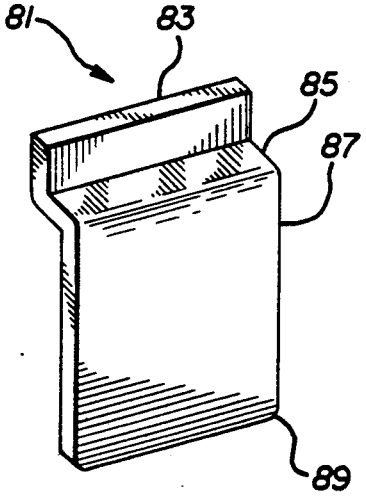
FIG. 6

PANEL FIXTURE

BACKGROUND OF THE INVENTION

1. Field of the Invention

This invention relates to the field of fixing devices, and in particular to a panel fixture adapted to be inserted into a cavity formed in a panel, and securely support a removable accessory bracket.

2. Brief Description of the Prior Art

Fixing devices are widely known in the art. A basic configuration of such devices is the familiar pegboard hanger, a hanger attached to a self-sticking base plate, or specially designed hangers which, with or without base plates, mate with long slots or channels or in a preformed panel. A special type of such prior art fixture includes a two-piece construction in which a base plate is screwed to a wall, pole or other surface, and has channels therein for receiving flanges of a separate accessory bracket. Examples of improvements over the basic pegboard/hanger arrangement can be found by reference to Thomas U.S. Pat. No. 459,844; Holden U.S. Pat. No. 66,341; Morgan U.S. Pat. No. 4,211,379; Bellasalma U.S. Pat. No. 3,704,675; and Shott et al. U.S. Pat. No. 4,860,905.

The Thomas patent shows a detachable step for poles. A step portion is inserted between two sockets of a plate. The plate defining the two sockets is screwed onto a pole and serves the sole purpose of supporting a separately installed detachable step. There is no unique method of mounting the plate to the pole, and there is no preparation of the pole necessary prior to mounting the plate, except perhaps to predrill the holes for the screws.

The Holden patent shows a shingling bracket having a main bracket portion to which is attached a bar. Similar to Thomas, the bracket is secured to the outside surface of the shingles or clapboard by slipping the top wedge-shaped portion under a shingle or clapboard or by nailing it to the outer surface of the structure, and by steel pins. Again, no preparation of the mounting surface is made prior to mounting the bracket, and the only manner of mounting the bracket portion is on the exterior of a structure.

Morgan relates to a panel board and mounting fixture combination and shows a panel board having slots in which a mounting fixture is located. The fixture comprises a suspension member, restraining member, and guide plate. A mounting extends outwardly and appears integral with and connected to the base member. Although mounting of the Morgan fixture requires a preformed panel board, the panel board is of a rather common design in which long horizontal grooves or channels are made in the panel so that the fixture can be placed in any one of the slots. This kind of mounting, which is rather popular in the point-of-sale display art, has at least two major disadvantages. First, since the channels have to be preformed, a number of them must exist in order to permit at least some variety of arrangement of fixtures on the panel, and this is evident from FIG. 1 of the Morgan patent which, in the small section depicted, shows three horizontal channels. In this arrangement, the fixture cannot be placed anywhere at random, but is confined to specific horizontal channels in the preformed panel. Secondly, in a display in which only a few or a moderate number of fixtures are needed, nevertheless the panel contains a large number of lengthy pieces of channeling which are not used and may detract from the aesthetic value of the display.

Bellasalma discloses a cantilever shelf assembly showing a bracket device bolted to a plaster wall. The bracket has a number of flanges, and an extending portion is adapted to fit within the bracket. Again, the backplate is mounted onto the outer surface of a wall and screwed into position. There is no preparation of the wall prior to the attachment of the bracket against the outer surface of the wall. Further, to work, the Bellasalma device requires that the back plate is extruded the full length of the accessory, in this case a shelf, which is to be rotated to fit into the backplate. There appears to be no means for preventing sideways movement of the shelf after mounting on the backplate, and, accordingly, if the accessory were a point-fixed item instead of a wide-shelf item, there is a question of stability of the mounting to keep the accessory in a secure position.

The Shott et al. patent shows a combination backplate and accessory from which the backplate is inserted horizontally into a slot in a wall, and the entire unit is then rotated through ninety degrees to position the security backplate against the back surface of the wall. In this patent, a hole is formed in the panelling, which hole can be formed at rather arbitrary positions, but the unit to be mounted in the hole is a unitary structure which is greatly limited. That is, if a different accessory is required, the entire unit must be removed from the panel, and a new accessory/backplate unit must be installed. Further, the Shott et al. bracket only fits a prescribed thickness of panelling, and a bracket that fits a thin panel could not be used on a thick panel.

It can therefore be appreciated that all of the panel fixtures of the prior art have a variety of drawbacks and deficiencies, and it is apparent that there is a need for an improved panel fixture in which: the fixture can be mounted arbitrarily at any location on the panel; the fixture can be mounted on a panel without a matrix of preformed channels much of which would not be used; the mounting of the fixture would be simplified and could even serve to mount the panel itself, together with the fixture, to a supporting wall structure; an accessory bracket mounted in the fixture would be strongly supported, secure and restricted against sideways movement; and the fixture could be accommodated into panels of varying thicknesses. It would also be beneficial to cover up any unsightliness of a mounted fixture by an attractive coordinated cover.

SUMMARY OF THE INVENTION

According to one aspect of the invention, there is provided a panel fixture adapted to support an accessory and to be inserted into a cavity formed in a panel having a front surface, the panel fixture comprising means for releasably receiving an accessory and means for fixing the panel fixture in the cavity. The body may include an upwardly projecting flange spaced rearwardly of the faceplate, the flange being engageable within a groove in the panel about the cavity, the cooperation of the flange and the groove providing resistance to removal of the body from the panel cavity when a load is applied to said panel fixture by said accessory.

In accordance with the invention, there is provided a panel fixture adapted to be inserted into a cavity formed in a panel, the panel fixture releasably receiving an accessory. In this manner, the panel fixture can be mounted within a routed cavity in a panel or wall such that its outer surface can be substantially flush with the panel surface or wall surface to provide a convenient, randomly selected location for supporting an accessory such as a hook bracket or a shelf support bracket.

In one embodiment of the invention, the mounting of the panel fixture into the cavity may serve a dual purpose, that of securing the fixture in the cavity formed in the panel and simultaneously holding the panel against a wall structure. This is accomplished, preferably, by providing a peripheral lip at the surface of the panel fixture, and mounting the panel fixture to the wall by means of a screw passing through the fixture and into the wall behind. Thus, the fixture itself is secured to the wall, and the lip about the flat surface of the fixture holds the panel in place as well.

Alternatively, a routed hole in the panel would produce a cavity with sidewalls and a bottom surface, and the panel fixture would be inserted into the routed cavity and secured to the bottom of the routed cavity in the panel. In this mounting of the panel fixture, the lip about the outer surface of the fixture would be decorative and hide the edges of the cavity but would not serve to support the panel against a wall as in the first-described usage of the fixture.

The panel fixture may be adapted to receive a variety of accessory brackets, and the preferred bracket is one which has a support plate to which a bracket is attached (e.g. by welding). In such a case, the panel accessory of the present invention may have a faceplate and a recessed planar surface parallel to the plane of the faceplate and located in a lower portion thereof. The faceplate may have a slot located in an upper portion of the fixture. The accessory bracket preferably has a stepped upper plate and a planar lower plate and is mountable in/on the fixture with the stepped upper plate of the accessory bracket inserted and confined in the slot of the fixture faceplate, and with the planar plate fitting flat against the recessed planar surface of the body of the fixture.

The fixture body may also comprise a stop member projecting rearwardly from the faceplate, whereby the top of the stepped upper plate of the inserted accessory bracket can be slipped behind the stop member upon insertion of the accessory bracket into the slot in the faceplate and engage the stop member after the planar lower plate of the accessory bracket rests against the recessed planar surface of the body.

A separate cover closure plate can be provided having a stepped upper plate portion and a planar lower plate portion, whereby when an accessory is not received in the panel fixture, the cover closure plate is fitted into the panel fixture with the upper plate of the closure plate being slipped behind the stop member upon insertion of the closure plate into the slot and engaging the stop member after the lower plate of the closure plate rests against the recessed planar surface of the body.

In a preferred embodiment, a flange projects upwardly from the top of the body of the fixture and is spaced rearwardly of the face plate. The flange is engageable with a groove provided in the upper wall of the cavity formed in the panel. Cooperation between the flange and the groove provides substantial resistance to removal of the body from the panel cavity when a load is applied to the panel fixture by the accessory. This would be especially desirable when accessories holding considerable weight are being supported by the panel fixture. There is no requirement for a lower flange portion on the body of the fixture, since any force applied to an inserted accessory bracket would be downwardly and into the surface of the wall which can accommodate extremely large forces. It is only the upper portion of the panel fixture which would experience possible withdrawal from the top of the cavity if excessive forces are applied.

IN THE DRAWINGS

Other features and advantages of the invention will be better appreciated by reference to the accompanying drawings in which:

FIG. 1 is a perspective view of a support structure configured as either a wall or a wall and panel combination, the wall or panel having a routed cavity therein for receiving a panel fixture according to the present invention;

FIG. 2 is a front elevational view of the panel fixture according to the invention;

FIG. 3 is a side elevational view of the fixture taken along the lines 3—3 in FIG. 2;

FIG. 4 is a cross-sectional view of the fixture taken along the lines 4—4 in FIG. 2, without screw mounting;

FIG. 4*a* is a cross-sectional view of the fixture taken along the lines 4—4 in FIG. 2, with screw mounting;

FIG. 5 is a rear elevational view of the panel fixture according to the invention;

FIG. 6 is a perspective view of the plastic cover/closure plate to be inserted into the panel fixture when an accessory bracket is not installed.

DETAILED DESCRIPTION OF THE PREFERRED EMBODIMENTS

FIG. 1 shows a support structure which can have several forms. It can be as small as a display for jewelry and the like, or as large as the entire wall of a room. The panel fixture of the present invention can be mounted onto a support structure 1 which may be in the form of a solid wall or thick panel, or it can include a panel 3 attached to, or to be attached to, a wall 5. In either case, a routed rectangular hole or cavity 7 can be made by known techniques, such as using a template and a standard routor. This will form sidewalls 9 which could extend completely through the panel 3 or could extend from the panel surface 15 rearwardly to a bottom wall 11 of the cavity if the panel or wall is thicker than the body of the panel fixture. In a preferred embodiment, the rectangular cavity 7 will have rounded corners 13 to be shaped complementary to the rounded corners of the panel fixture to be inserted in cavity 7.

In FIG. 2, a front view of the panel fixture 21 is shown. In the field of art to which the invention pertains, the panel fixture 21 might be referred to as a fixing device for a wall, or a receiver for an accessory, and like terms. For convenience and consistency in this description, it will be referred to as a panel fixture 21.

A faceplate 53 of the panel fixture 21 has a relatively large upper portion 23 and a continuous lip 54 which extends around the entire periphery of the fixture 21. The lower portion 25 of fixture 21 is defined by a large recessed surface 56 which is spaced from the surface of faceplate 53 by a small distance equalling the thickness of an inserted accessory bracket (see also FIG. 4). With this construction, a relatively narrow, but plate-like, accessory bracket is confined between the interior side portions of lip 54 due to the fact that the accessory bracket fits below the surface of faceplate 53 and against the recessed planar surface 56.

A slot 27 is located in the upper portion 23 of the fixture, the top of the slot 27 extending rearwardly from the surface of faceplate 53, and the bottom of slot 27 extending rearwardly of the recessed planar surface 56.

A V-shaped channel 29 (see also FIGS. 3 and 4) extends rearwardly from the recessed planar surface 54 by means of sloped upper and lower faces 31, 35, respectively, the two sloped faces being joined by a center face 33 through which a screw hole 37 is formed. As best seen in the embodiment of FIG. 4, a screw protruding through hole 37 can be screwed into the bottom of a routed cavity (a toggle bolt can also be used) or to a wall structure to provide additional support the panel fixture against the cavity bottom or wall structure. However it is not necessary that the screw be used, and in FIG. 4*a*, the panel fixture 21 is supported in the cavity 7 without the additional need for a screw. The flange 41 provides substantial strength to the insertion of the bracket and simultaneously permits easy removal of the fixture 21 when not required and very considerable stability when inserted in the cavity to support relatively large loads. This is particularly useful when the wall or substrate behind the panel is unsuitable for fixing by virtue of its location or material.

Preferably, the fixture 21 has rounded corners 39, 40, both for the body of the fixture (FIG. 5) and for the lip 54.

For added security against removal of the panel fixture by the application of excessive forces to an accessory bracket, an upwardly projecting securement flange 41 can be provided rearwardly of the faceplate 53. In the arrangement shown in FIG. 2, the securement flange 41 is shown to extend upwardly beyond the extent of the upper part of lip 54 and is intended to be slid into a slot or behind a thinned portion of the panelling or wall structure into which the panel fixture is to be mounted. Again, in this embodiment of the invention, the means by which this can accomplished is quite simple, since many manufacturers of router bits can supply a bit which has the prescribed thickness and depth, and the location of the slot for the securement flange 41 is a minor matter for the average worker using a standard routor.

FIG. 3 better shows some of the parts already described in connection with FIG. 2, and in particular shows the V-shaped channel 29 in better detail.

The body of the panel fixture 21 can be described as comprising all of the arrangement behind the face plate 53, as seen in FIGS. 3 and 4. Part of that body is a peripheral rim 61,63,65 which extends around the entire periphery of the body of the panel fixture 21 and has a curved top rim portion 61 and a curved bottom rim portion 63 of substantial depth. A short side rim portion 65 joins the top rim portion 61 and bottom rim portion 63. The side rim portion 65 may not be a raised ridge at all, but simply the outer side of the recessed planar surface 56. Of course, the rim does not have to be continuous as shown in the drawings, and, if in the form of a raised ridge, is narrowed at the side rim portion 65 for the purpose of saving raw material.

A shelf 71 is provided and serves two purposes. It has an upwardly extending back part which, when an accessory or cover plate is not attached to the panel fixture, hides the bottom of the cavity or the wall structure behind the panel fixture 21 so as not to be unsightly from a front view of the fixture. Second, it provides additional rigidity to the mounting of the panel fixture 21 by the contact it makes with the bottom of the routed cavity or the wall behind the mounted panel fixture. For this purpose, the rear surface of the vertical 71*a* of shelf 71 may extend further rearwardly than the most rearward surface of the center segment 33 of the V-shaped channel 29.

The cross-sectional view of FIG. 4 illustrates the manner in which a standard accessory bracket 91 is mounted in the panel fixture 21. The accessory bracket 91 comprises a plate-like hanger support 93 which has attached thereto, usually by welding, a hanger 95 on which a shelf is placed or display items are hung or otherwise supported. To insert the accessory bracket 91 in place, the offset latching flange 97 is first inserted into slot 27, and the bracket 91 is then rotated clockwise (in FIG. 4) until the lower plate 94 of the accessory bracket 91 rests against the recessed planar surface 56 and the upper part of offset latching flange 97 is brought against a rearwardly projecting accessory stop 73 defining the top wall of slot 27. The lower or horizontal part 71*a* of shelf 71 has a bearing ledge 72 which supports a bearing step 96, part of the stepped upper portion of the accessory bracket 91. In this manner, there is downward force applied between the bearing step 96 and bearing ledge 72, a stopping force applied by offset latching flange 97 against the rearward surface of accessory stop 73, and a substantial rearwardly directed force between the lower plate 94 of the accessory bracket 91 and the recessed planar surface 56 of the panel fixture.

Mechanically, this arrangement provides an extremely secure attachment of the accessory bracket 91, since the interior sides of lip 54 will prevent the lower plate 94 of the accessory bracket from moving left and right. It is, of course, desirable that any accessory bracket used with the invention be of the type that has its plate-like construction to match complementarily the wide slot 27 and large recess planar surface 56 as best seen in FIG. 2.

The rear view of the panel fixture 21, as seen in FIG. 5, shows elements of the invention previously described. Ribs 69 are clearly shown in FIG. 3. These ribs 69 create an interference fit with the sidewalls 9 of a routed cavity 7. The routed cavity 7 can be formed by using a routor template which will result in a precisely shaped rectangular cavity with rounded corners exactly fitting the outer surface geometry of the peripheral rim 61, 63, 65. In the embodiment wherein flange 41 is insertable into a slit 42 in the upper sidewalls 9 of cavity 7, the procedure for mounting the fixture would be to insert the flange 41 into the cavity 7 first and then swing the fixture downwardly until fully seated in the cavity 7, at which time the ribs 69 would be forced into the sidewalls 9 to create the aforementioned interference fit. This is not only contributory to the overall stability of the fixture after being mounted in a cavity 7, but also aids in the installation of the fixture by the fact that a simple single hand motion can insert the fixture into position, and it can be held there by the action of ribs 69 against the sidewalls 9 until the installer can insert a screw through hole 37 and screw the fixture to the bottom wall 11 of the cavity or wall 5, as the case may be.

In FIG. 6, the closure plate 81 is shown. This can be formed of steel or plastic and is insertable into the panel fixture 21 in the same manner as the accessory bracket 91 described earlier. The closure plate 81 has an offset latching flange 83, a bearing step 85, a faceplate 87, and round corners 89, all of which function similarly to the corresponding parts of the accessory bracket 91 described earlier.

As thus described, the panel fixture is able to be positioned at any location on a panel without being limited to the prescribed positions of a preformed channeling arrangement. The cavity 7 can be routed at any desired location in a panel easily and without the use of special tools other than a common routor and can be enhanced by the usage of an appropriate template.

When the invention is used with a panel of a prescribed thickness which substantially matches that of the body of the panel fixture 21, the screw through the hole 37 will not only mount the panel fixture 21 to the wall 5, but the action of the lip 54 against the outer peripheral panel surface 15 of the cavity 7 will draw the panel 3 against wall 5. If, for example, a display would be enhanced by the provision of different colored individual small panels surrounding each panel fixture/accessory bracket combination, it would be a simple matter to form a hole 7 completely through each of the small panels 3, insert a panel fixture 21 therein, and secure both pieces simultaneously to a wall 5 to produce a colorful decorative arrangement. Alternatively, a single wall panel with a multiplicity of routed holes 7, placed at any desirable locations in the panel 3, would be held against a supporting wall by the mounting of multiple fixtures in a corresponding number of holes in such a large panel.

As indicated earlier, in the event that the thickness of the wall 5 or wall panel 3 would be greater than the thickness of the body of the fixture 21, a routed cavity with a bottom surface 11 would accommodate the panel fixture 21 in the same manner as it would in mounting a panel to a wall, but in the latter case, the screw through screw hole 37 would mount the fixture 21 to the thick panel or wall.

In either case, the body of the fixture 21 is inserted between the sidewalls 9 of the hole or cavity 7 such that only the panel face plate 53 extends beyond the panel surface 15, resulting in not only added security by the fact that the fixture is mounted within a cavity in a panel, but also in an aesthetically pleasing panel fixture compared to those which have a base plate mountable to the surface of a wall or pole by means of multiple screws. In the instant case, with the routed cavity or hole 7, a single screw holds the fixture in place, as well as the panel surrounding it, if desired.

The panel fixture of the present invention is configured to accept a number of different accessory brackets, for example most standard Slatwall TM metal backplates manufactured by Australian Slatwall Industries Pty Limited, Waterloo, Australia. The fixture permits a wall panel to be secured to a supporting wall by the mounting of the fixture itself to such supporting wall, and it permits a solid wall to be routed to accept a fixture where desired, either random or orderly. The fixture may eliminate the need for long slots in panelling or extruded metallic inserts, and allows "point fixing" of display accessory brackets. It also may eliminate the need to screw a fixture onto the surface of a wall or other object, which may result in an unsightly appearance and/or marginally secure fixture. The fixture can be inexpensively cast in a unitary monolithic unit.

The present invention has been described in accordance with a preferred embodiment. Variations and modifications of many of the elements of the invention can be made resulting in embodiments not described herein, without departing from the spirit and scope of the invention. It is to be understood, however, that the invention is not to be limited by the specific embodiments described, but rather is to be limited only by the appendant claims.

I claim:

1. A panel fixture for supporting an accessory and adapted to be inserted into a cavity formed in a panel having a front surface, said panel fixture comprising:

means for releasably receiving an accessory;

means for fixing said panel fixture in the cavity to a wall;

a body insertible within the cavity;

a faceplate on said body, said face plate being substantially flush with the front surface of the panel when inserted in the cavity;

a lip at least partially surrounding said faceplate; and means, spaced inwardly from said faceplate for securing said body to the panel within the cavity.

2. The fixture as claimed in claim 1, wherein said means for fixing includes means for attaching said panel fixture to a bottom of the cavity.

3. The fixture as claimed in claim 3, wherein:

said body comprises upper and lower portions, a recessed planar surface parallel to the faceplate and located in the lower portion of said fixture;

a slot located in said faceplate at the upper portion of said fixture so that an accessory bracket, having a stepped upper plate and a planar lower plate, is mountable on said fixture with the stepped upper plate in said slot, and the planar lower plate fitting flat against said recessed planar surface of said body.

4. The fixture as claimed in claim 3, wherein said means for securing said body comprises a depression extending from and projecting rearwardly of said recessed planar surface, said depression having an aperture through which an attachment member can be inserted.

5. The fixture as claimed in claim 4 wherein the panel is secured to a wall behind the panel, and the attachment member is attached to said wall.

6. The fixture as claimed in claim 5 wherein the attachment member is a screw.

7. The fixture as claimed in claim 3, wherein said body comprises a stop member projecting rearwardly from said faceplate, such that the stepped upper plate abuts behind said stop member upon insertion of the accessory bracket into said slot and the planar lower plate rests against said recessed planar surface of said body.

8. The fixture as claimed in claim 7, further comprising a cover closure plate comprising:

a cover stepped upper plate; and a cover planar lower plate; whereby, when an accessory is not received in said panel fixture, said cover closure plate is fitted to said panel fixture with said upper plate being located behind said stop member upon insertion of said closure plate into said slot and said lower plate rests against said recessed planar surface of said body.

9. The fixture as claimed in claim 1, wherein said body includes an upwardly projecting flange spaced rearwardly of said faceplate, said flange being engageable within a groove in the panel about the cavity, the cooperation of said flange and the groove providing resistance to removal of said body from the panel cavity when a load is applied to said panel fixture by said accessory.

10. The fixture as claimed in claim 1 further comprising an upwardly projecting flange being engageable within a groove in the panel about the cavity, the cooperation of said flange and the groove providing resistance to removal of said fixture from the panel cavity when a load is applied to said panel fixture by said accessory.

11. The fixture as claimed in claim 2 wherein the means for attaching comprises ribs.

12. A panel fixture for supporting an accessory and adapted to be inserted into a cavity formed in a panel having a front surface, the panel fixture comprising:

a body insertable within the cavity, the body comprising upper and lower portions, and a recessed planar surface located in the lower portion of the fixture;

a faceplate on the body with the recessed planar surface being parallel to the face plate, the faceplate being substantially flush with the front surface of the panel when inserted in the cavity;

a lip at least partially surrounding the faceplate;

a slot located in the faceplate at the upper portion of the fixture so that an accessory, having a stepped upper plate and a planar lower plate, is mountable on the fixture with the stepped upper plate in the slot, and the planar lower plate fitting flat against the recessed planar surface of the body;

means for releasably receiving an accessory;

means for fixing the panel fixture in the cavity to the wall; and means, spaced inwardly from the faceplate, for securing the body to the panel within the cavity.

13. The fixture as claimed in claim 12 wherein the means for fixing includes means for attaching the panel fixture to a bottom of the cavity.

14. The fixture as claimed in claim 12 wherein the means for securing the body comprises a depression extending from and projecting rearwardly of the recessed planar surface, the depression having an aperture through which an attachment member can be inserted.

15. The fixture as claimed in claim 14 wherein the panel is secured to a wall behind the panel, and the attachment member is attached to the wall.

16. The fixture as claimed in claim 15 wherein the attachment member is a screw.

17. The fixture as claimed in claim 12 wherein the body comprises a stop member projecting rearwardly from the faceplate, such that the stepped upper plate abuts behind the stop member upon insertion of the accessory into the slot and the planar lower plate rests against the recessed planar surface of the body.

18. The fixture as claimed in claim 17 further comprising a cover closure plate comprising:

a cover stepped upper plate;

a cover planar lower plate;

whereby, when an accessory is not received in the panel fixture, the cover closure plate is fitted to the panel fixture with the upper plate being located behind the stop member upon insertion of the closure plate into the slot and the lower plate rests against the recessed planar surface of the body.

19. The fixture as claimed in claim 13 wherein the body includes an outwardly projecting flange spaced rearwardly of the faceplate, the flange being engageable within a groove in the panel about the cavity the cooperation of the flange and groove providing resistance to removal of the body from the panel cavity when a load is applied to the panel fixture by the accessory.

* * * * *